US006186358B1

(12) United States Patent
Peteraf

(10) Patent No.: US 6,186,358 B1
(45) Date of Patent: Feb. 13, 2001

(54) FROZEN PRODUCT VENDING MACHINE

(76) Inventor: Alfred W. Peteraf, 549 Maryland Ave., Perryville, MD (US) 21903

( * ) Notice: Under 35 U.S.C. 154(b), the term of this patent shall be extended for 0 days.

(21) Appl. No.: 09/205,320

(22) Filed: Dec. 4, 1998

Related U.S. Application Data

(60) Provisional application No. 60/067,754, filed on Dec. 5, 1997.

(51) Int. Cl.[7] ..... G07F 11/00
(52) U.S. Cl. ..... 221/85; 221/155
(58) Field of Search ..... 221/155, 84, 85, 221/71, 76, 150 R, 150 HC, 131, 119, 120

(56) References Cited

U.S. PATENT DOCUMENTS 3,263,857 * 8/1966 Krakauer et al. ..... 221/119
3,344,953 * 10/1967 Krakauer et al. ..... 221/155
5,392,953 * 2/1995 Maldanis et al. ..... 221/155

OTHER PUBLICATIONS

Rowe International Inc., Model 487 Ice Cream Vendor Specification Sheet, 1984, published by Rowe International, Inc., Whippany, New Jersey, U.S.A.

* cited by examiner

*Primary Examiner*—Kenneth W. Noland
(74) *Attorney, Agent, or Firm*—Law Offices of Royal W. Craig

(57) ABSTRACT

A method and apparatus for an improved frozen vending machine having a glass front which provides the customer the opportunity to view the actual product they wish to purchase, while ensuring the maintenance of a freezing environment and utilizing a product conveyor system which reliably delivers a larger selection of frozen product to the customer than has been available in the past. The present invention also provides a method and kit for modifying existing vending machines into the frozen vending machine described herein.

10 Claims, 10 Drawing Sheets

FROZEN PRODUCT VENDING MACHINE

CROSS-REFERENCE TO RELATED APPLICATIONS

The present application is based on provisional application No. 60/067,754, filed Dec. 5, 1997.

BACKGROUND OF THE INVENTION

1. Field of the Invention

The present invention relates to frozen product vending machines and, more particularly, to an improved frozen product vending machine having a glass front which provides the customer the opportunity to view the actual product they wish to purchase, while ensuring the maintenance of a frozen storage environment and utilizing a product conveyor system which reliably delivers a larger selection of frozen products to the customer than has been available in the past. The present invention also provides a method and kit for modifying existing vending machines into the frozen vending machine described herein.

2. Description of the Background

Frozen product vending machines are typically configured with an outer casing having a hinged front access door, a hinged inner barrier door, and a refrigerated inner section behind the barrier door containing a series of conveyors which carry frozen product and deliver the same to a particular opening in the access door for retrieval by a consumer. However, the methods in which the products are displayed to the consumer and the details of how the products are carried through the machine to the consumer vary widely.

Many frozen vending machines in the past have offered the consumer only a graphical depiction of the product they wish to purchase on a front access panel of the machine. The consumer inserts their coin into the machine and presses one of three selection buttons, in turn powering an electric motor to drive a vertical conveyor system just behind the panel depicting their desired product. The consumer then lifts the access panel, revealing the conveyor system, and slides their desired product out from between the panels of the vertical conveyor. Not only have these machines in the past resulted in excessive heat exchange both in reloading product and in operation by the consumer, but the consumer is often disappointed when the product they receive is either not quite as appealing as, or altogether different from, the one depicted on the access panel graphic.

Many current non-frozen product vending machines incorporate a glass front. The incorporation of a glass front in these machines vastly improved the commercial potential of standard vending machines, allowing consumers to view the products which they wished to purchase, thus ensuring confidence in the consumer that they were purchasing exactly what they thought they were purchasing. However, attempts to incorporate a glass front into frozen product vending machines have been less successful due to the need for maintaining a frozen environment behind a panel having a high rate of heat transfer.

More recent frozen product vending machines have attempted to incorporate a glass front to allow customers to view the products therein. However, such devices utilize traditional, horizontal, spiral product delivery mechanisms which make the preservation of a frozen environment difficult at best. The spiral product delivery mechanism requires that new product be placed in a precise orientation for proper machine operation and product delivery, thus increasing the amount of time it takes a delivery person to refill the machine with product. This additional period of heat exchange results in the melting and disconfiguration of the frozen product, and can even result in product spoilage. Further, the driving motors for the spiral product delivery mechanism are positioned inside of the frozen area, creating a harsh operating environment for the driving motors and an associated decrease in motor life and reliability. Likewise, the 22 gauge wire typically used to interconnect the motors with the electrical control system become brittle inside of the frozen compartment and are easily broken.

Other frozen vending machines display a non-saleable, artificial replica of the frozen products vended by the machine. After viewing the artificial products, a customer makes their selection by depressing the appropriate selection button, and a robotically controlled vacuum device retrieves the actual product from a chest freezer. In this configuration, the customer again is unable to view the actual product which they wish to purchase.

Both the spiral product delivery machines and the robotically controlled vacuum machines are complicated devices, the complexity of which vastly adds to the expense of these systems and increases the need for machine mechanics with more advanced technological skills, even for simple maintenance and troubleshooting.

Still other vending machines exist which vend other refrigerated products such as milk, soda, etc. Unfortunately, to date, no easy method exists of converting these machines into a more profitable frozen product vending machine. Thus, the typical vending machine owner of older or less profitable machines who desires to reap the profit potential of a frozen product vending machine is faced with either removing the machine from operation and losing the related income, or replacing the machine with a new vendor at large expense.

It would therefore be advantageous to provide an improved frozen product vending machine which could securely maintain a frozen environment for storing the product while enabling the consumer to view the actual product they wish to purchase. It would also be advantageous to provide a kit and method for converting existing, unprofitable vending machines into a profitable frozen product vending machine using little technical expertise and little expense for upgrading and modifying components.

SUMMARY OF THE INVENTION

It is, therefore, an object of the present invention to provide an improved frozen product vending machine which displays the actual product being sold to the consumer through a glass front panel while maintaining an environmentally secure frozen storage environment.

It is another object of the present invention to provide an improved frozen product vending machine utilizing a product delivery system which maximizes the vending machine's product capacity while ensuring consistent product delivery and ease of reloading without excessive heat exchange or damage to the product.

It is still another object of the present invention to provide an improved frozen product vending machine that can be easily diagnosed and repaired in the event of a breakdown.

It is still another object of the present invention to provide a method and kit for converting existing, less profitable vending machines into frozen product vending machines having the features described herein at roughly half of the cost of purchasing an entirely new machine.

In accordance with the above objects, an improved frozen product vending machine is disclosed. The machine is provided with a hinged front panel having a traditional product selection panel, coin receiver, and access opening for retrieving vended product. The front panel is also provided with a central opening through which a consumer may view the interior frozen product storage compartment.

Inside of the machine and behind the hinged front panel is a freezer cabinet fitted with a steel enclosure fixedly attached to its front face. The steel enclosure is provided with an upper opening and a lower opening. The upper opening is fitted with a hinged, heated glass door which provides an environmentally secure frozen product storage environment within the machine's housing. The hinged, heated glass door is aligned with the central opening in the front panel and a refrigerated frozen product conveyor system within the frozen product storage compartment, such that a consumer may view from outside the actual products to be vended from the machine. The steel enclosure on the front face of the freezer cabinet is also equipped with a hinged access door which aligns with the access opening in the front panel and a frozen product receiving compartment within the frozen product storage compartment, allowing a consumer to retrieve their selected product by pushing open the hinged access door.

Lastly, the frozen product storage compartment is equipped with a multiple, horizontal conveyor frozen product delivery system comprising a series of electric motor-driven endless conveyor chains which carry a series of guide plates. The guide plates in turn cradle and transport the frozen products within the machine to a dropping point where the guide plates expel the frozen products to a frozen product receiving compartment. The guide plates comprise a three-dimensional elongate block having a top face, a bottom face, a back face, and one end face, the front face and opposing end face of the block remaining open to allow access to the product cradled by the guide plate. The guide plates thus cradle the product therein from both the top and the bottom, allowing product to be dispensed only when the front face of the guide plate is directed downward. This guide plate configuration offers an endless product conveyor delivery system having both an upper span and a lower span, vastly increasing the available storage capacity and selection choices over what has been available in past machines.

The motors are controlled by a central, commercially available motor controller which initiates a predesignated motor after a consumer has made a product selection. The controller directs a driving signal to the appropriate motor, driving that motor's associated conveyor until the frontmost product is dropped from the conveyor. In one embodiment of the present invention, as the product drops from its conveyor to the frozen product receiving compartment, it passes through a projected laser light beam to activate a diffuse photoelectric switch, which in turn activates a motor operation timer. The timer allows the driven motor to continue driving its particular conveyor for a predetermined amount of time, allowing the conveyor to advance the next guide plate and product to the delivery position, such that product may be immediately delivered from that conveyor upon selection by another consumer.

Also provided is a method and kit for converting older, less profitable vending machines into frozen product vending machines of the instant invention. The present invention may be used to convert existing Rowe Model 487 Ice Cream Vendors and Rowe Model 495 Milk Vendors to the present invention, utilizing the existing outer cabinet and front panel hardware components. Thus, the current invention utilizes the simplistic, proven reliable technology of the Rowe Model 487 Ice Cream Vendors and Rowe Model 495 Milk Vendors to provide a frozen product vending machine with the added improvement of a glass front. As described in detail below, the hardware on the rear of the front panel may be relocated while maintaining all of the existing electrical connections, allowing the front panel itself to be reconfigured with the necessary openings for the present invention. Alternatively, the control mechanisms on the existing machines may be replaced with the motor controller described below in reference to the first stated embodiment of the present invention. Finally, either the existing motors or those described below in the first stated embodiment of the present invention may be mounted on a standard freezer cabinet, and the existing conveyors and guide plates modified to a horizontal configuration within the freezer cabinet. The freezer cabinet is then fitted with a steel enclosure to maintain a secure frozen environment, and the reconfigured assembly is able to provide both greater selection and product holding capacity than has been available in past machines, at a cost of approximately half of that of a new frozen product vending machine.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
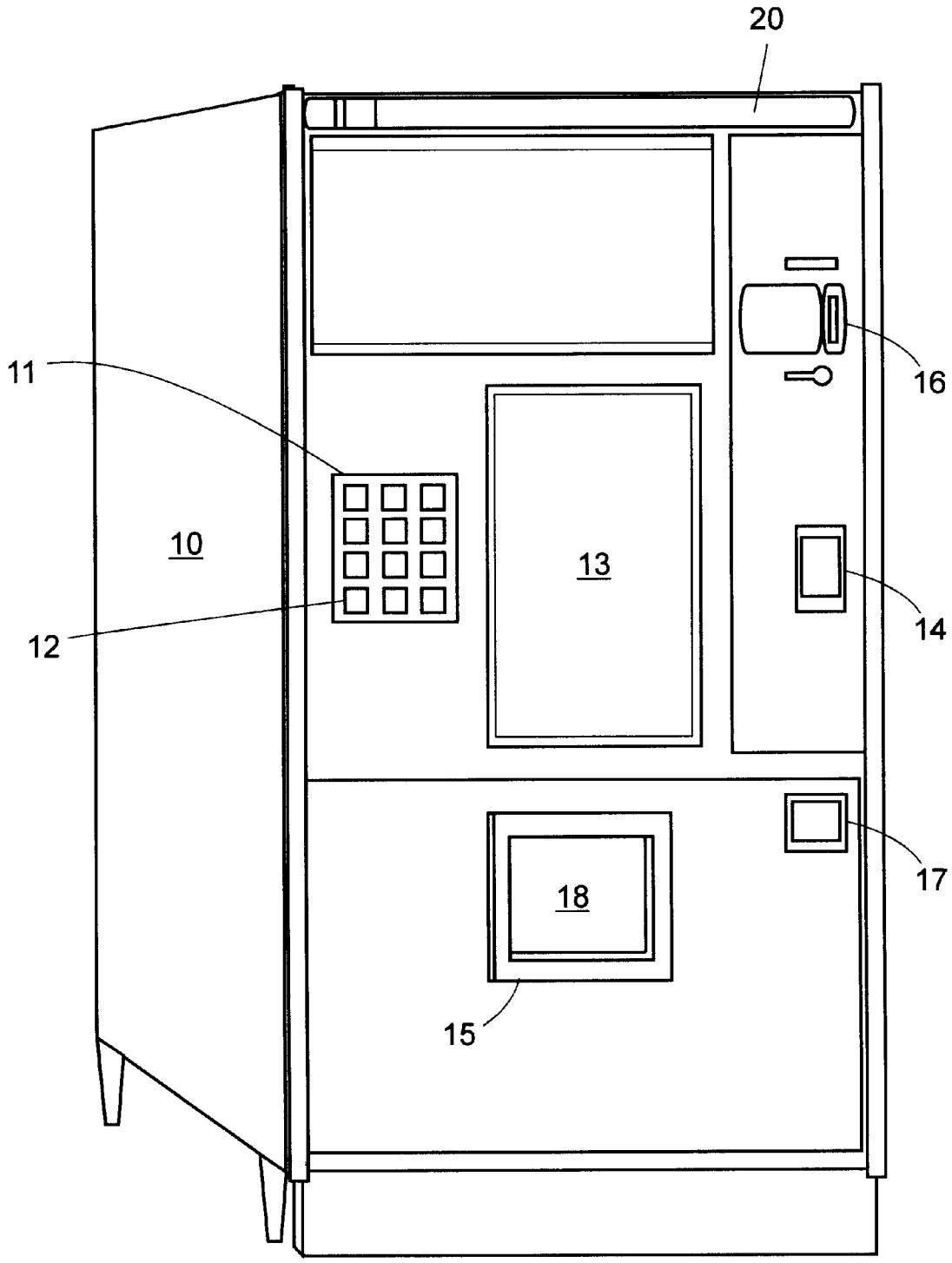
FIG. 1 is a perspective view of the frozen product vending machine of the present invention.

FIG. 1 is a perspective view of a frozen product vending machine of the present invention. The machine outer body is comprised of a hollow, open-faced outer cabinet 10 and a front panel 20. Front panel 20 is attached to outer cabinet 10 via hinges along one edge of front panel 20, such that front panel 20 may be opened to allow access to the inner frozen product storage area and the front panel hardware (i.e., electronic selector switches, coin receiver, etc., discussed below). Front panel 20 is equipped with a selection panel 11 having a series of selector switches 12 which, when depressed, operate the appropriate internal electric motor (discussed below) to advance the selected frozen item to a frozen product receiving compartment behind a front panel access opening 15. A suitable selection panel is commercially available from Coinco as Model 9302GX Keypad electronically coupled to a Model C-80 controller. After a product has been selected through depressing the appropriate selector switch 12, the consumer simply reaches into front panel access opening 15, pushing open a hinged access door 18 to reveal the vended product.

Front panel 20 is also equipped with a central opening 13 positioned in direct alignment with the display window of an interior frozen product compartment, such that a consumer may readily view the actual products within prior to purchase. Front panel 20 also incorporates a conventional vending machine locking mechanism 14 and conventional vending machine coin and dollar bill receiving and return slots 16 and 17.

Figure 2A:
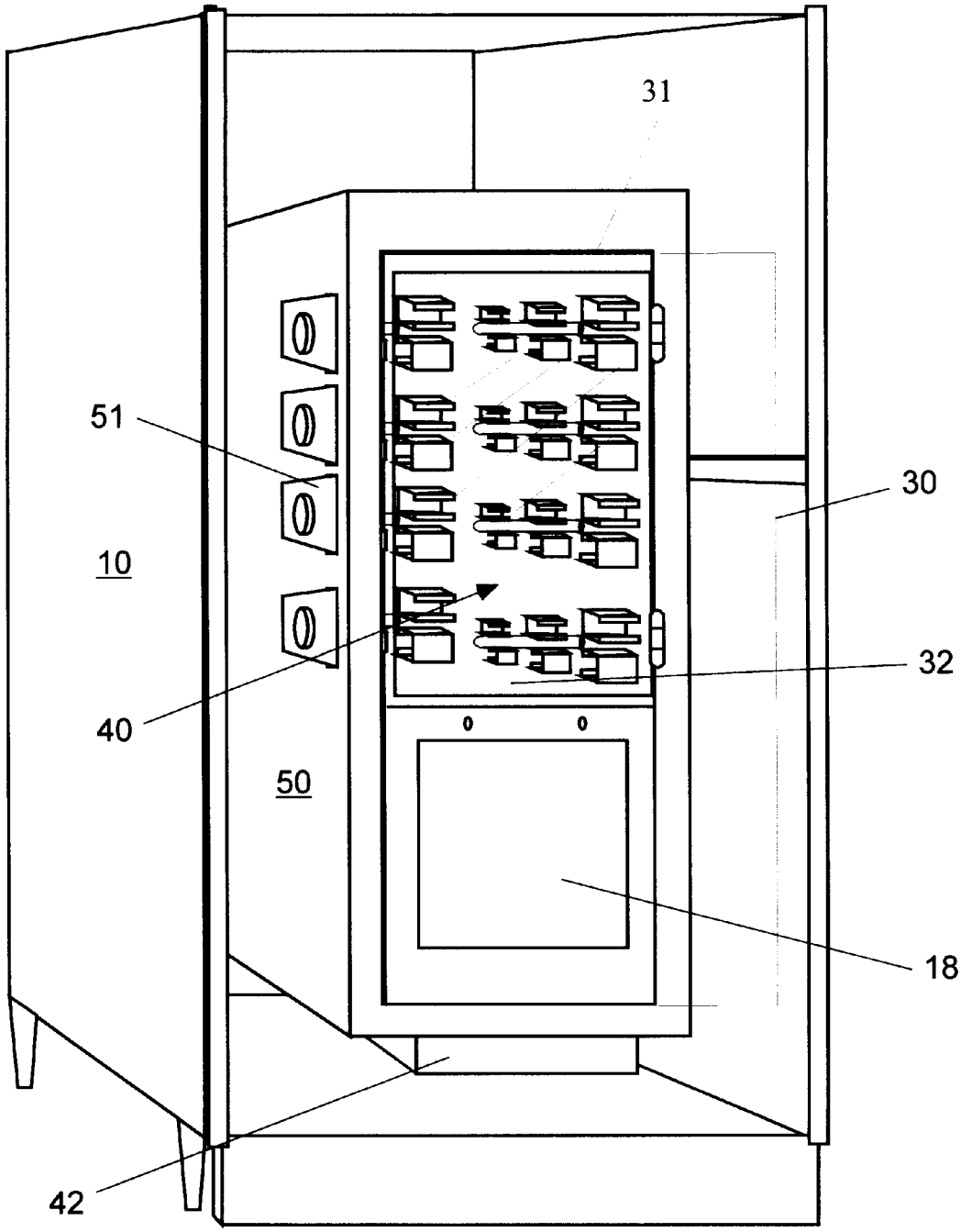
FIG. 2A is a perspective view of the interior of the frozen product vending machine of the present invention.

FIG. 2 shows the interior of outer cabinet 10, in which is housed the inner frozen product storage compartment (shown generally at 40). Frozen product storage compartment 40 comprises a modified chest freezer 50 (described in detail below) which is placed within the hollow interior of outer cabinet 10. The bottom of chest freezer 50 is placed on a simple 4 inch or other appropriately dimensioned wooden platform 42 to raise the chest freezer to the appropriate level for viewing through glass door 32 from outside the machine. In a second embodiment of the present invention, chest freezer 50 is slidably mounted to platform 42 using sliding rails (not shown) on the bottom of the freezer cabinet or, alternatively, on the inner sidewalls of outer cabinet 10, enabling the entire frozen product storage compartment 40 to be slid outward from the interior of cabinet 10 to provide easy access to motors 51 for servicing. A suitable chest freezer is commercially available from Kelvinator as Model No. 1KG403, although any chest freezer having generally similar dimensions would suffice.

The open front face of chest freezer 50 is fitted with a steel enclosure panel 30. Steel enclosure panel 30 is dimensioned to precisely mate with the front face of chest freezer 50 when the front door of freezer 50 is removed. As shown in the side view of chest freezer 50 and front enclosure panel 30 of FIG. 2B, the rectangular, rear open face of enclosure panel 30 mates directly with channel 46 on the front face of freezer cabinet 50, and is affixed to the front face of freezer cabinet 50 using screws or similarly arranged fasteners.

Referring again to FIG. 2A, steel front enclosure panel 30 is provided with an upper opening 31 in direct interior alignment with the frozen product storage compartment 40, and in direct exterior alignment with front panel central opening 13 when the front panel 20 is in its closed position. Upper opening 31 is closed with a heated, hinged glass door 32. A suitable heated glass door is commercially available from Excellence as model number ELD-4. Glass door 32 allows easy access to the frozen product storage compartment 40, allowing simple and efficient replacement of product with a minimum of heat exchange. A magnetic gasket seal is provided around the periphery of the underside of glass door 32, sealing the gap between the rear surface of glass door 32 and front enclosure panel 30, thus ensuring the maintenance of a frozen environment within the frozen product storage compartment. In this fashion, a serviceman may access frozen product storage compartment 40 simply by opening front panel 20 and opening glass door 32. As traditional frozen product vending machines include a barrier door covering the full interior of outer cabinet 10, minimizing the opening to glass window 32 vastly reduces the heat exchange that occurs during routine filling operations. Likewise, through this arrangement, a serviceman may access motors 51 for repair or maintenance without compromising the frozen environment within frozen product storage compartment 40.

Steel front enclosure panel 30 is also provided with a lower hinged access door 18, allowing a consumer to retrieve their purchased product after it has been dropped to a frozen product receiving compartment within the frozen product storage compartment. Hinged access door 18 is arranged such that when front panel 20 is in its closed position, hinged access door 18 is readily visible and accessible through front panel access opening 15.

Figure 2B:
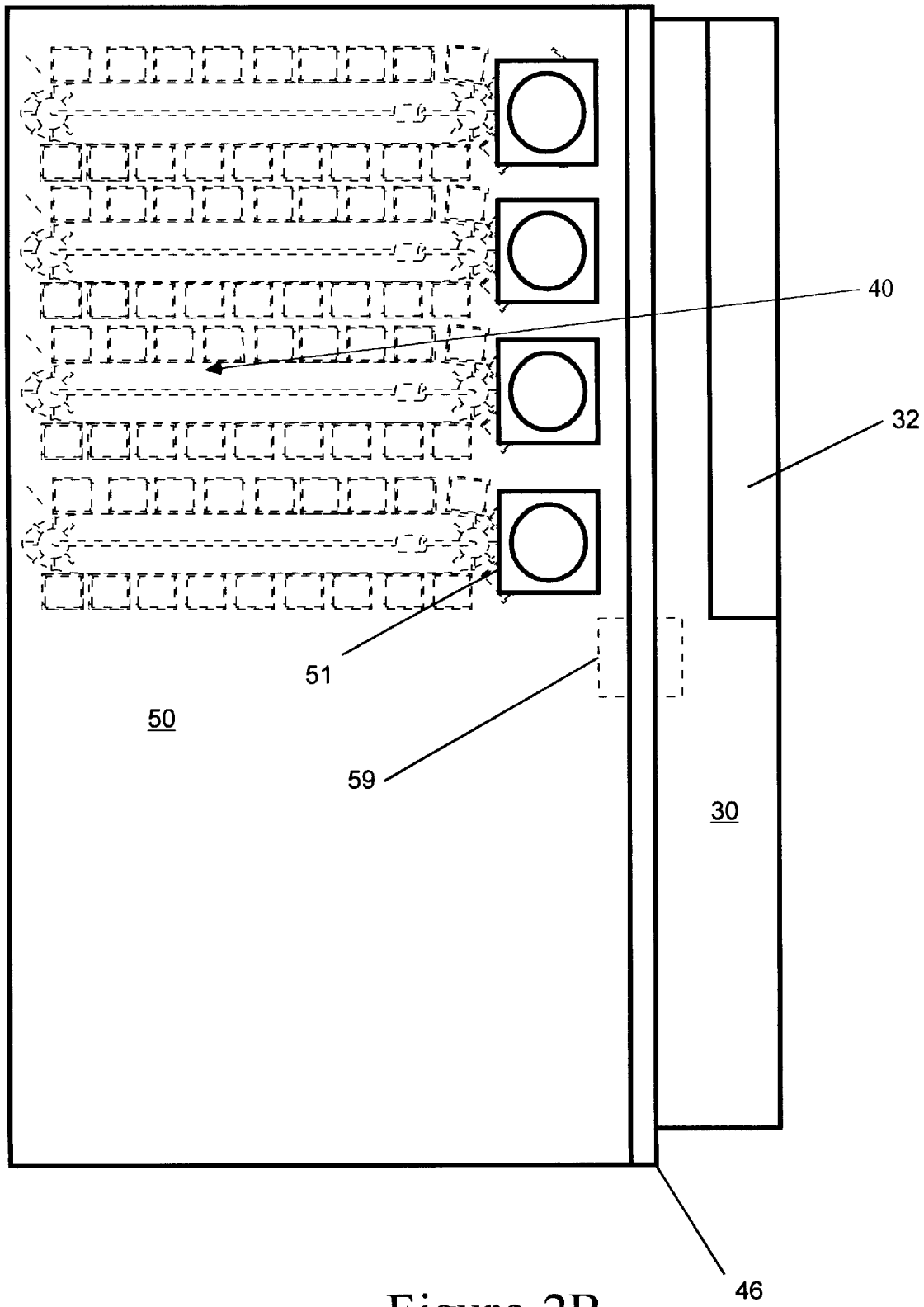
FIG. 2B is a side view of the inner frozen product storage compartment.

In an alternate embodiment of the present invention, and as shown in phantom in FIG. 2B, a laser operated switch 59 may be provided, mounted at the juncture of the front face of freezer cabinet 50 and the rear face of steel enclosure panel 30. A suitable laser operated switch is a diffus photoelectric switch, and is commercially available from OMRON as model number E35-DS5E21. Laser 59 is positioned within the path of the product as it falls from the frozen product storage compartment 40 to open cavity 44 (FIG. 3), such that as the product falls, it interrupts the laser's projected beam and triggers the photoelectric switch. The photoelectric switch in turn triggers a timing device within a motor controller 18 (FIG. 4) mounted on the rear of front panel 20 and commercially available from OMRON as moto controller model number CPM-1A-CDRA. The motor controller then allows the driven motor to continue to rotate its respective conveyor for a predetermined amount of time to advance the conveyor to the next product delivery or "ready" position.

Figure 3:
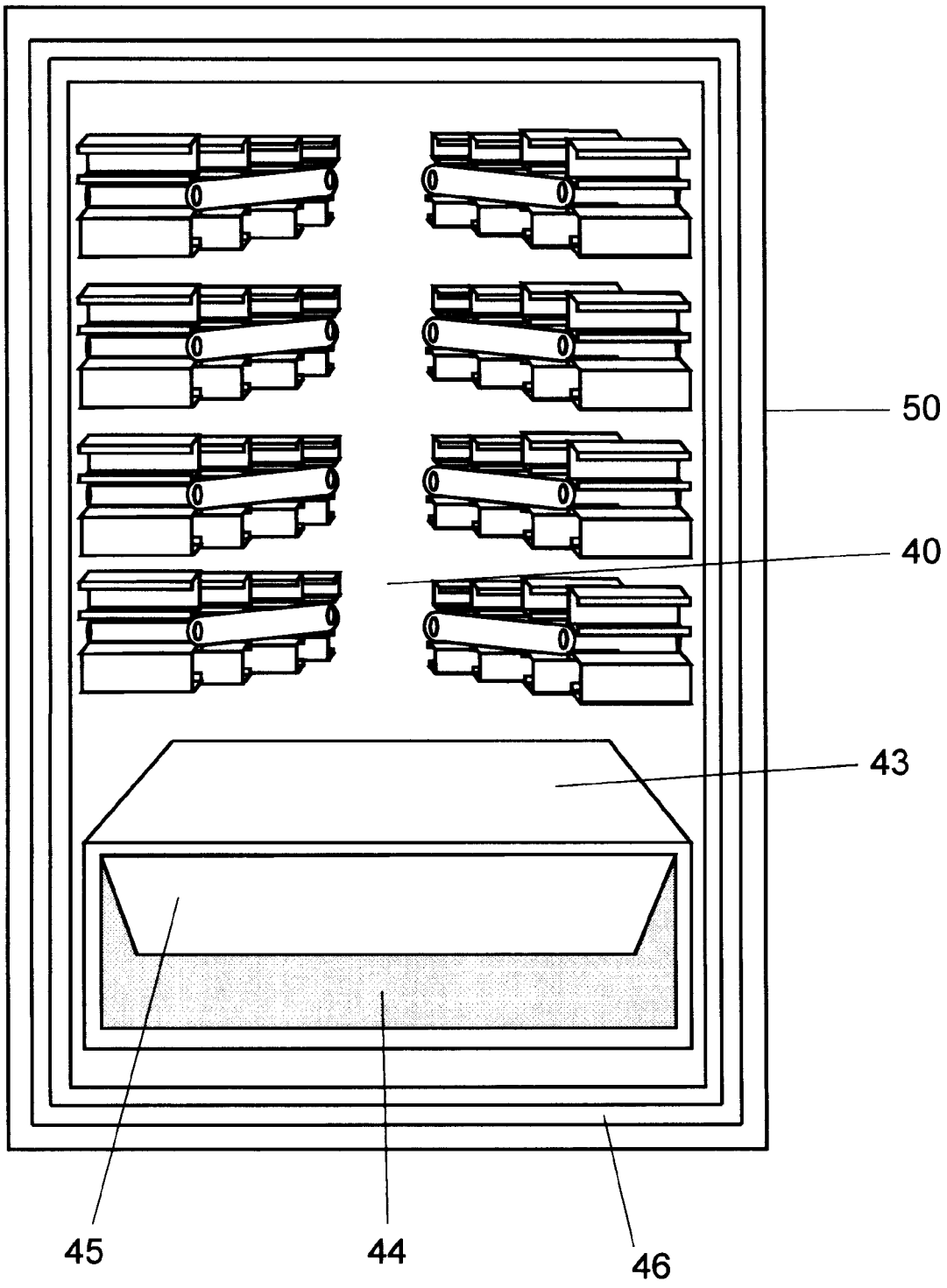
FIG. 3 is a front perspective view of the inner frozen product storage compartment.

FIG. 3 shows the interior of inner frozen product storage compartment 40. Access to frozen product storage compartment 40 is gained by opening hinged front panel 20 and glass door 32 on front enclosure 30. Placed in the bottom of chest freezer 50 is a frozen product receiving compartment 43, defining an open cavity 44 which a consumer may access through opening hinged door 18 (FIGS. 1 and 2) to retrieve the vended product. When a product is selected, it is dropped to the bottom of freezer cabinet 50 and comes to rest either in front of or just inside of open cavity 44. When hinged door 18 is opened to retrieve the vended product, the consumer then has free access to open cavity 44, while access to the frozen product storage compartment 40 is blocked by angled top plate 45. Top plate 45 is configured to allow free rotation of hinged door 18 backwards until the back of door 18 butts against top plate 45, allowing full access to open cavity 44 while denying access to frozen product storage compartment 40.

Figure 4:
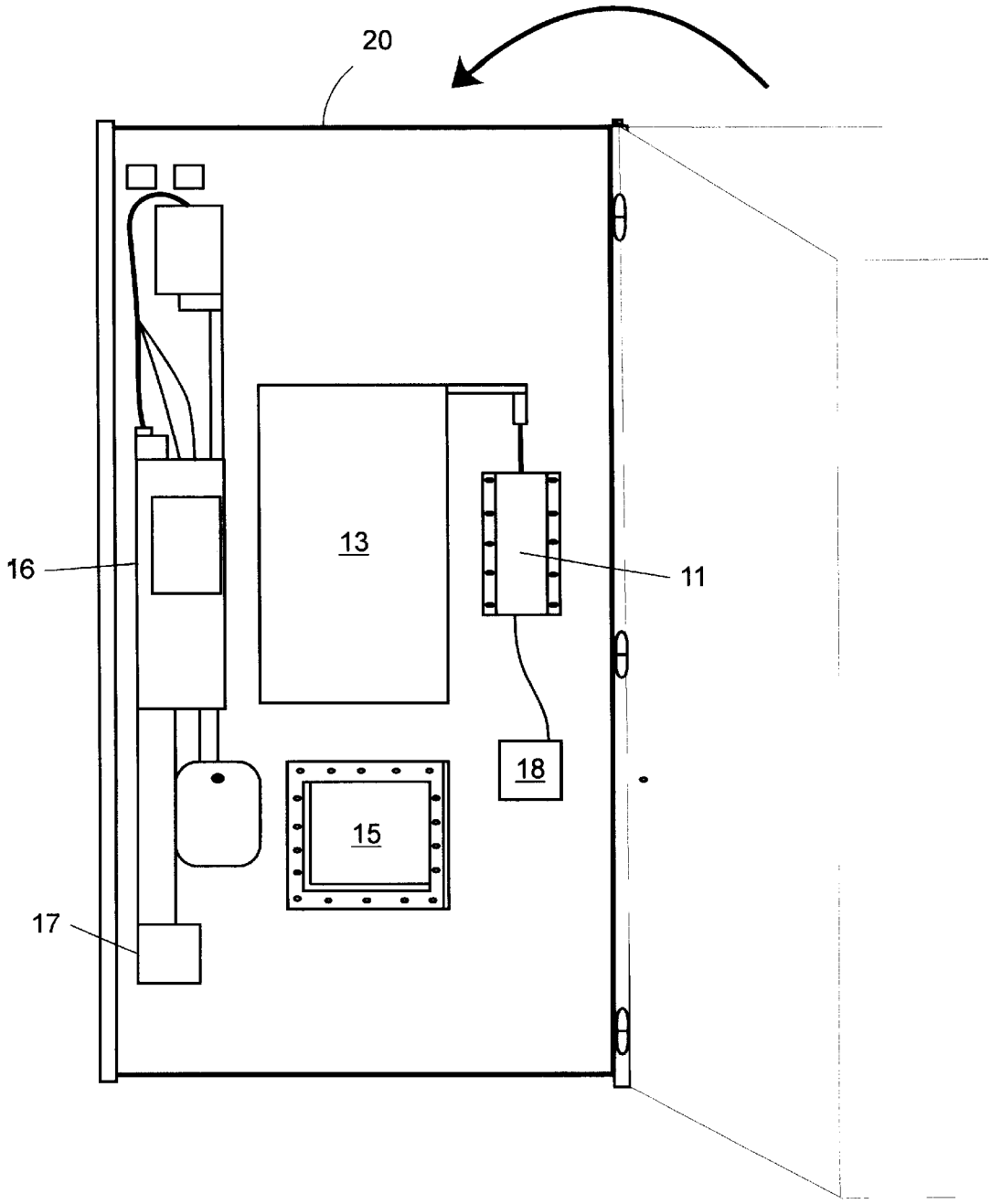
FIG. 4 is a perspective view of the rear of front panel 20 of the present invention.

FIG. 4 shows the back of front panel 20. As in traditional vending machines, front panel 20 is equipped with conventional coin and dollar bill receiving and return slots 16 and 17, and selection panel 11. Selection panel 11 in turn is electrically coupled to motor controller 18. Selection panel 11 comprises a keypad which is commercially available from Coinco as model number 9302 GX, and model C-80 keypad controller. Likewise, motor controller 18 is commercially available from OMRON as model number CPM-1A-CDRA. As explained above, front panel 20 is provided with a central opening 13. Central opening 13 is positioned in front panel 20 such that opening 13 is positioned in direct alignment with the display window of an interior frozen product compartment when front panel 20 is closed. Likewise, front panel 20 is provided with front panel access opening 15, allowing a consumer access to the vended product via hinged access door 18.

Figure 5:
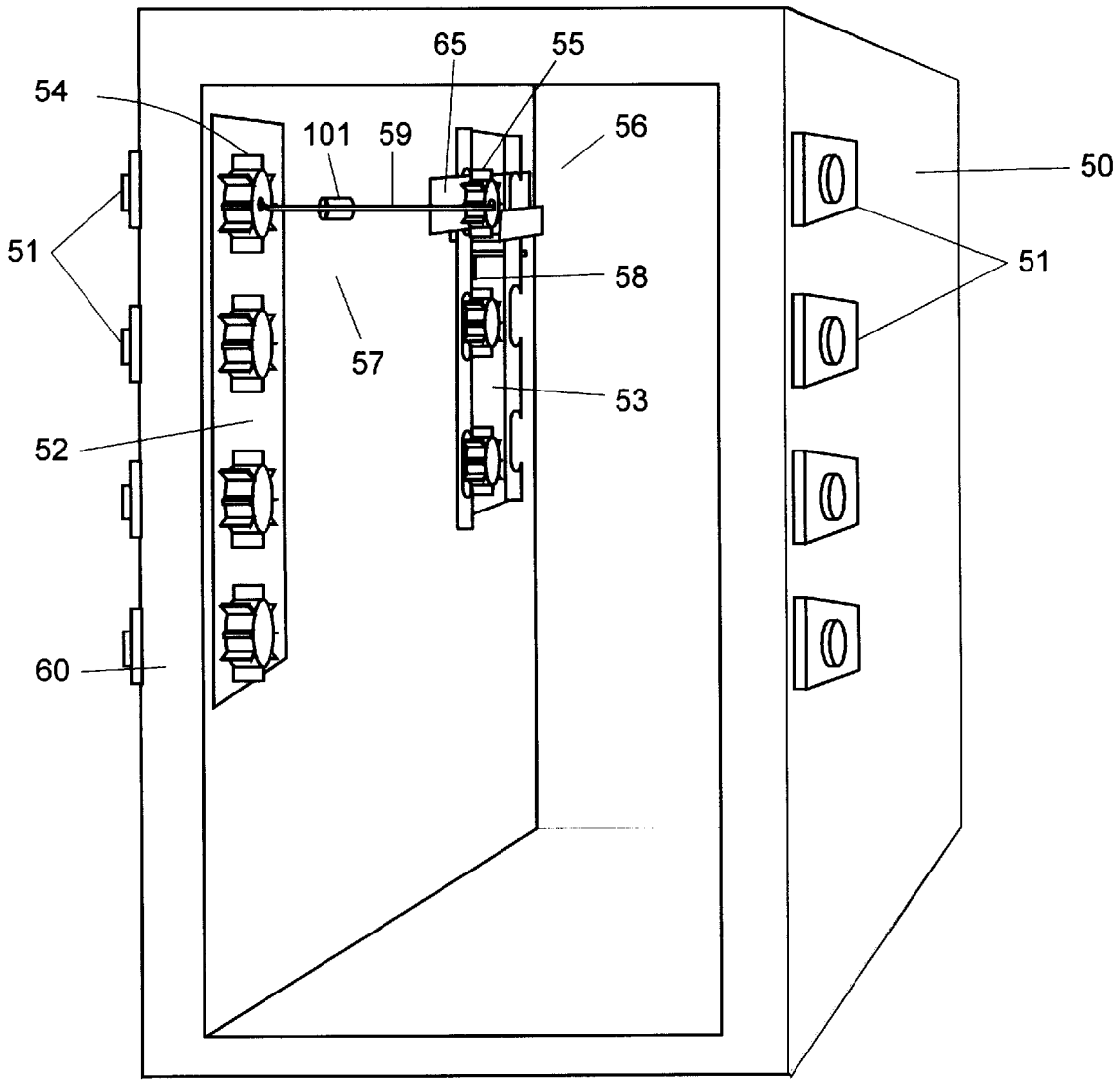
FIG. 5 is a close-up perspective view of the modified chest freezer 50 of FIG. 3.

FIG. 5 shows a chest freezer cabinet 50 which has been equipped with a series of four vending motors 51 running vertically along both sides of the exterior of freezer cabinet 50. Suitable vending motors are commercially available from Oriental as model number SMK216A-GN. Vending motors 51 are used to drive front gears 54 which, in combination with rear gears 55, carry conveyor assembly 70 (see FIG. 8). Front and rear gears 54 and 55 are commercially available from Oriental as gear head model number 2GN15KA. The teeth of gears 54 and 55 engage the links of the frozen product conveyor assembly 70 (FIG. 8) to advance product to frozen product receiving compartment 43 in the bottom of chest freezer 50 (FIG. 3).

Front gears 54 are supported and held in place by the driving axes of vending motors 51. The axles of front gears 54 pass through front brackets 52 and engage the ends of the driving axes of vending motors 51. Vending motors 51 are bolted or otherwise fastened to both sides of the exterior of freezer cabinet 50, slightly behind the front opening of freezer cabinet 50. Likewise, rear gears 55 are supported and held in place by rear sprocket support plates 65 (See FIG. 6). Rear sprocket support plates 65 are in turn held by rear brackets 53 which are bolted or otherwise fastened to both sides of the interior of freezer cabinet 50, slightly in front of the rear surface of the interior of cabinet 50. Rear sprocket support plates 65 rotatably support the axes of rear gears 55, and slidably engage notched sections of the sidewalls of rear brackets 53 (See FIG. 7). A horizontal extension plate extends outward from the rear sprocket support plate 65, and a vertical flange extends upward from the horizontal extension plate and engages the opposite end of rear gear 55.

Figure 6:
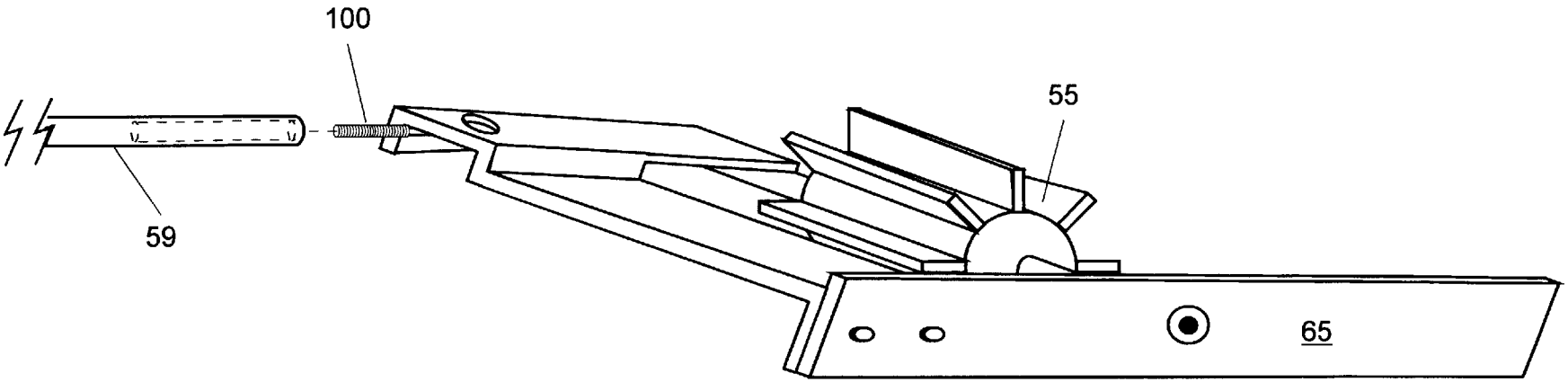
FIG. 6 is a perspective view of the rear gear 55 and supporting structure therefor.
Figure 7:
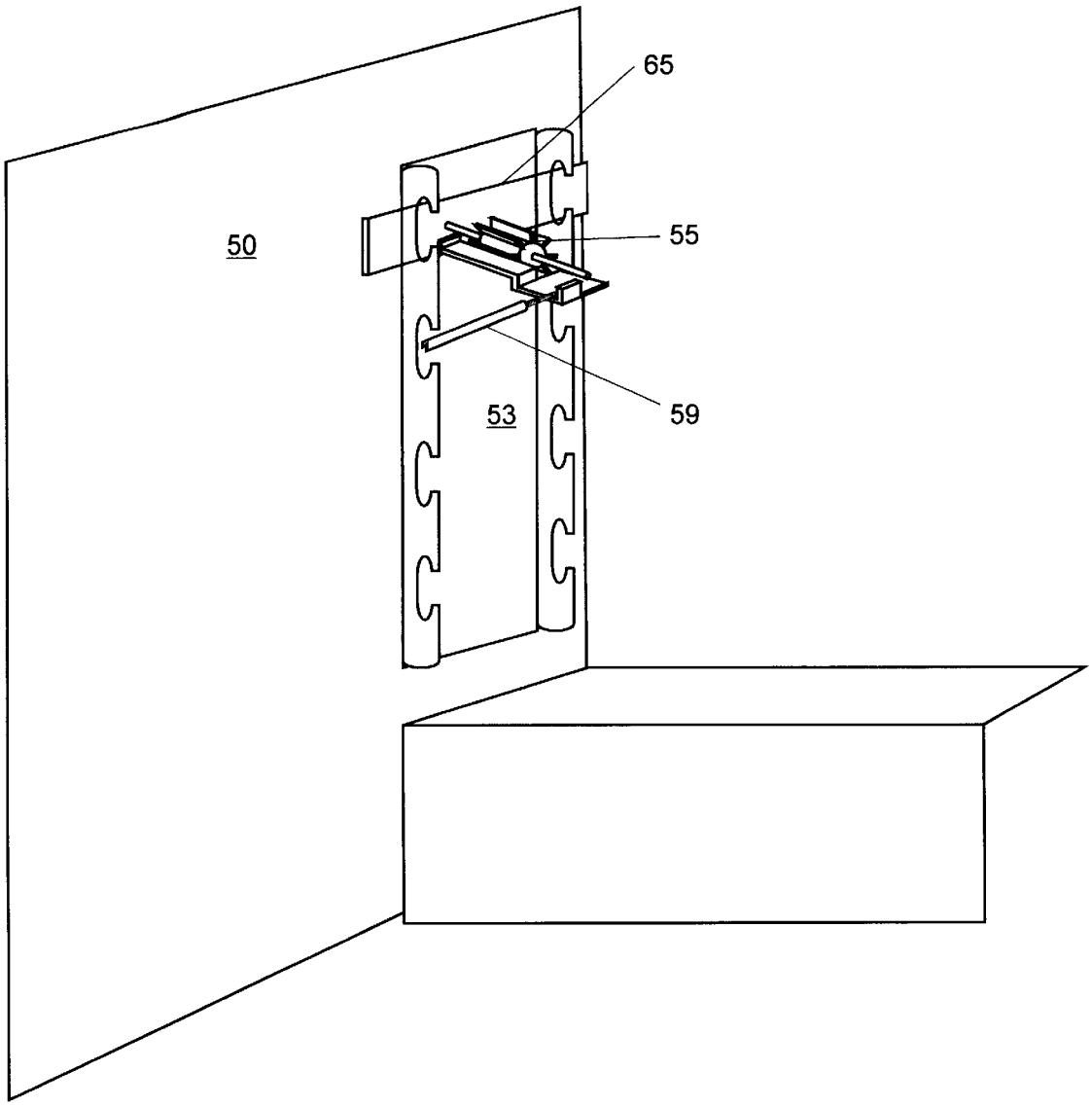
FIG. 7 is a perspective view of the rear bracket 53 of the present invention.

As in conventional conveyor driven vending machines, an adjustable-length tension rod 59 extends between front and rear gears 54 and 55. As shown in FIG. 6, tension rod 59 is hollow at its rear end such that it slides over an extension rod 100 of the rear sprocket assembly. Likewise, the front sprocket assembly is provided with an identical extension rod 100 which in turn is affixed to a tension bolt 101 (FIG. 6), which is hollowed to receive the front end of tension rod 59. When tension bolt 101 is turned, tension rod 59 is pushed farther from the front sprocket assembly, in turn moving rear sprocket 55 further towards the rear of cabinet 50, thus removing slack from the conveyor assembly 70 such that the upper and lower sections of conveyor assembly 70 run in parallel to one another and to the upper and lower surfaces of cabinet 50.

Figure 8:
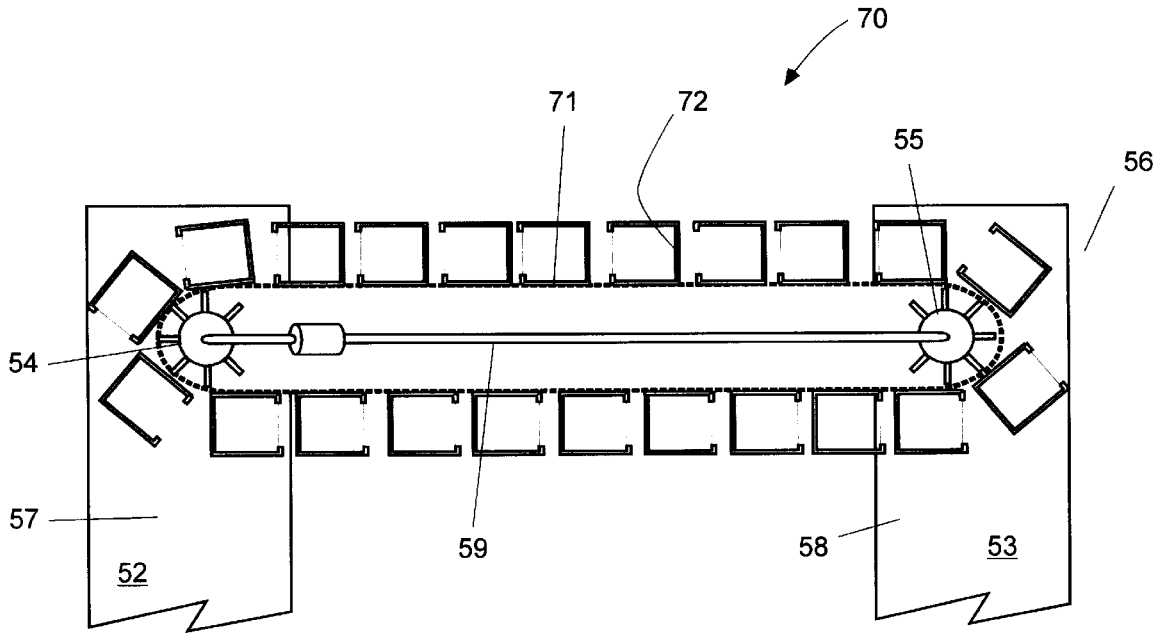
FIG. 8 is a side view of the conveyor assembly 70 of the present invention.
Figure 9:
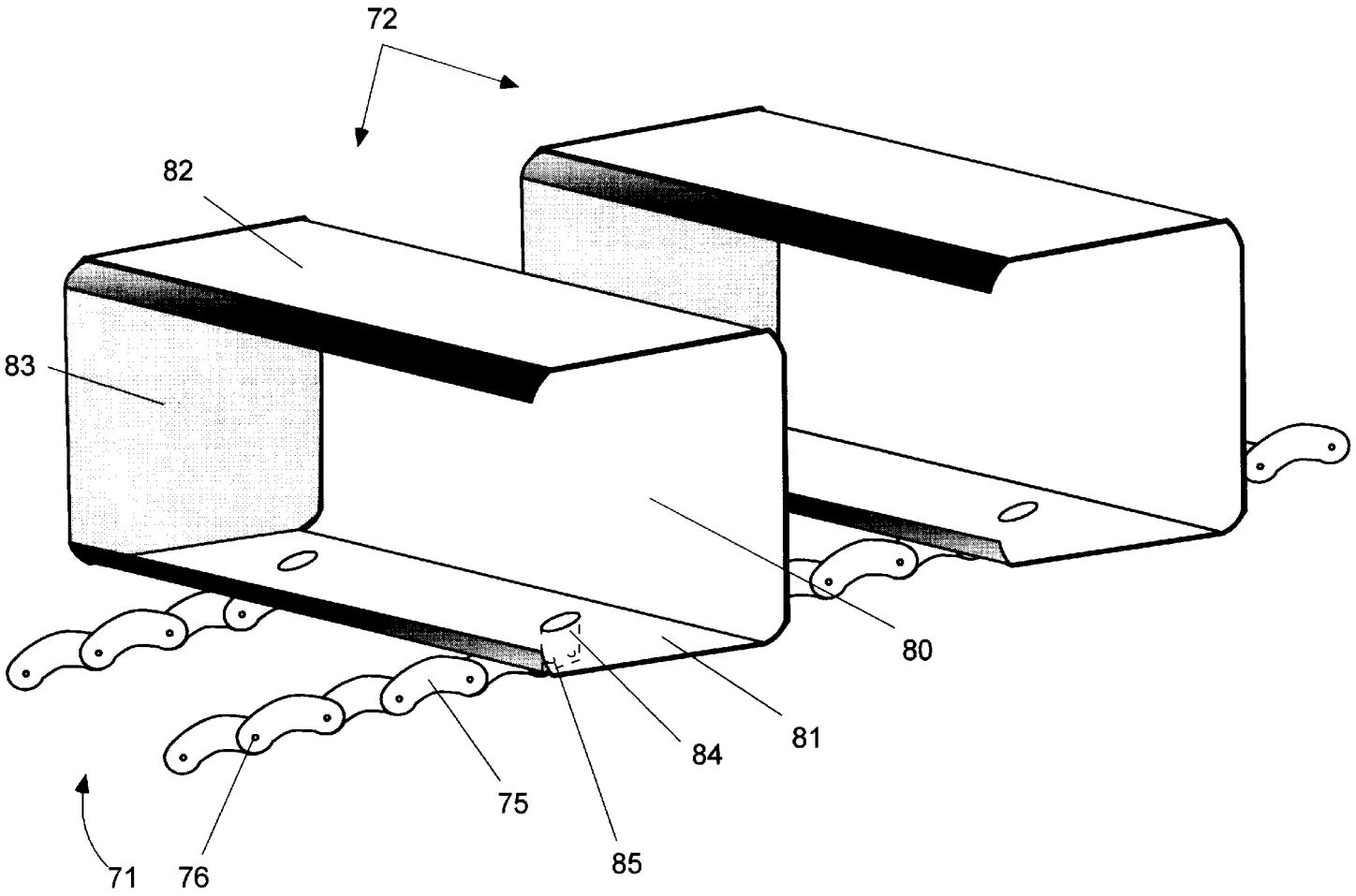
FIG. 9 is a close-up perspective view of the chain conveyor 71 and guide plates 72 of the present invention.

FIG. 8 shows a detailed view of conveyor assembly 70. As particularly shown in FIGS. 8 and 9, conveyor assembly 70 consists of chain conveyor 71 and guide plates 72. As may be seen more clearly in FIG. 9, chain conveyor 71 comprises a series of parallel nylon chain links 75. Each link is pivotally connected at both of its ends to another link using pins 76 as with any standard chain assembly. However, pins 76 are provided sufficient length such that a portion of each pin 76 extends outward from the flat face of link 75. Guide plates 72 are configured with a nearly vertical back panel 80, bottom panel 81, top panel 82, and end panel 83, such that a frozen product is cradled in each support tray as it advances along the conveyor assembly. Guide plates 72 are also provided with a downward flange 84 having holes 85 therein which receive the exposed portion of pins 76, thus providing a snap connection for snapping guide plates 72 onto nylon chain 75. Thus, guide plates 72 may be easily removed to accommodate frozen products of varied sizes. In operation, the tines of front and rear gear heads 54 and 55 engage links 75 to advance the conveyor assembly such that the next available frozen product is dropped into frozen product receiving compartment 43 (FIG. 3).

Referring back to FIG. 9, it may be seen that the configuration of the conveyor assembly 70 will allow frozen product to be loaded and carried by the chain conveyor 71 and guide plates 72 along both the upper and lower spans of conveyor assembly 70. While bottom plate 81 supports the frozen products from below as they are carried across the top span of the conveyor assembly, top plate 82 supports the frozen products from below as they are carried across the bottom span of the conveyor assembly. Likewise, top plate 82, bottom plate 81, and rear plate 80 all serve together to cradle the frozen product as it is carried around the rearward turn of the conveyor assembly to the upper span. Thus, the present invention nearly doubles the frozen product storage capacity for a horizontal frozen product conveyor assembly.

Thus, by utilizing a horizontal conveyor assembly, the present invention is able to offer a wider selection of frozen products to the consumer than have been available in the past with traditional vertical conveyor system vending machines, while being capable of carrying nearly the same amount of product as was available in those traditional machines for each product that is offered. Finally, by incorporating a compact, horizontal conveyor assembly system into a frozen product vending machine, the present invention allows a frozen product vending machine to be equipped with a glass front, such that consumers may view the actual product they wish to purchase, as opposed to a "mock-up" or graphical depiction of the product.

Retrofit of Existing Vending Machines

While the present invention may be entirely manufactured as a new unit, a particular feature of this invention is the ability to convert existing, unprofitable vending machines into frozen product vending machines which offer a larger and more aesthetically appealing variety of product than has been available from frozen product vending machines in the past. Thus, a vending machine owner may be presented with the option of converting an existing machine into a frozen product vending machine of the present invention at approximately half the cost of purchasing an entirely new machine.

To convert an existing vending machine into the present invention, the first step is to select a freezer cabinet to fit within the outer cabinet 10 of the existing vending machine, leaving a clearance of at least six inches on either side of the freezer cabinet to safely receive vending motors 51. To convert existing frozen and refrigerated product vending machines, namely, Rowe Model 487 Ice Cream Vendors and Rowe Model 495 Milk Vendors, a suitable freezer cabinet is commercially available from Kelvinator as model number iKG403. An opening is cut in the rear of the existing outer cabinet 10 using a circular saw equipped with a steel blade. The opening is dimensioned to snugly receive the rear section of freezer cabinet 50, and is finished with steel trim. The original gasket from the front door of freezer cabinet 50 is removed, and the front door of freezer cabinet 50 is discarded.

To prepare the existing vending machine, the existing conveyor assembly and existing compressor are removed from the interior of cabinet 10, leaving behind the original wiring. Freezer cabinet 50 is then equipped with the OMRON motor and horizontal conveyor assembly fully described above in the following manner.

Front brackets 52 receive the axles of front sprockets 54. Assembled front brackets 52 are then bolted to the interior side walls of freezer cabinet 50 towards the front opening of the freezer cabinet, and rear brackets 53 are adhesively attached to the interior side walls of freezer cabinet 50 towards the rear wall of the freezer cabinet. Vending motors 51 (Oriental model number CPM-1A-CDRA) are then mounted on the exterior sidewalls of freezer cabinet 50, having their driving axes placed through the sidewalls of freezer cabinet 50 to engage an end of the axles of front sprockets 54, and the motors are bolted in place. Next, the rear sprockets 55 are slid into the slots in rear brackets 53. The completed conveyor assembly 70 (comprising nylon chain conveyor 71 and guide plates 72 as described above) is then placed over the front and rear sprockets 54 and 55, and a tension rod is affixed to the extension rods 100 of each sprocket assembly. The tension rod length is then adjusted to remove any slack in the upper or lower spans of the conveyor assembly 70.

Finally, the front opening of freezer cabinet 50 is fitted with a steel enclosure panel 30 including a heated, hingedly attached front glass window 32 and a lower hinged access door 18, as described in detail above.

The completed adapted freezer cabinet 50 is then placed in the outer cabinet 10, and fixed in place with wood frame 41. Alternatively, sliding rails may be mounted on the interior sidewalls of cabinet 10 to position freezer cabinet at any desired height.

After freezer cabinet 50 has been affixed to the interior of outer cabinet 10, barrier door 30 is removed from the outer cabinet 10 and discarded. Next, the interior of front panel 20 may be modified as necessary to reposition the existing hardware and to provide the necessary openings. When converting a Rowe Model 487 Ice Cream Vendor to a frozen product vending machine of the present invention, the original vend door assembly and push button selection assembly are removed from front panel 20. The original vend door assembly is discarded, and a central opening 13 is cut so as to provide an opening in direct alignment with the glass door assembly 32 on barrier door 30, opening 13 being slightly smaller than glass door assembly 32. Thus, a consumer may readily view the contents of the machine through glass door 32. The original push button assembly is then disassembled and reconfigured in a new push button mounting box to provide the multiple selection buttons mounted vertically alongside of opening 13. Alternatively, an existing push button assembly from a Rowe Model 495 Milk Vendor may be substituted.

When converting a Rowe Model 495 Milk Vendor to a frozen product vending machine of the present invention, the original push button assembly is likewise removed from front panel 20, and the original front panel 20 is cut with a central opening 13 in direct alignment with the glass door assembly 32 on barrier door 30, opening 13 being slightly smaller than glass door assembly 32. The original push button assembly is then again mounted vertically alongside of opening 13.

Following the reconfiguration of front panel 20, the electrical connections may be made using the identical wiring from the original machine that was left in the interior of outer cabinet 10 when the conveyor assemblies were removed. Because all of the original selection hardware remains on front panel 20, the connections in the interior of outer cabinet 10 are made by simply attaching the appropriate selector lead wires to their respective vending motors 51.

In the above described processes for retrofitting existing frozen product vending machines with the improvements of the instant invention, a machine owner is able to easily upgrade an existing, less profitable machine to a glass front frozen product vending machine for the cost of the assembled freezer cabinet. The entirety of the remaining structure is salvaged from the earlier machine, thus vastly reducing the cost of upgrading the machine. However, instead of using the existing control hardware, the owner may alternately replace the existing control hardware with the OMRON motor controller described above, providing the machine with the added improvements of reversible motors for assisting in the reloading of frozen product, and multiple product price settings for any single conveyor system. In such event, the machine owner is still able to salvage the entirety of the original machine's outer cabinet, once again vastly reducing the cost of upgrading a less profitable machine to one including the benefits of the instant invention.

While the present invention is preferably used to convert existing frozen and refrigerated product vending machines, namely, Rowe Model 487 Ice Cream Vendors and Rowe Model 495 Milk Vendors, it may be used to convert any existing vending machine which utilizes a 115 Volt delivery mechanism, including traditional canned soda machines. In these alternate machines, the vend signal again may be directed to the appropriate vending motor 51 of the present invention, and the appropriate openings may be made in front panels 20 and barrier doors 30 so as to provide a consumer with visual access to the interior of the frozen product storage compartment.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. A frozen product vending machine comprising:

an outer cabinet having a hollow interior;

a front panel hingedly attached to said outer cabinet having an upper product viewing opening and a lower product retrieving opening;

a refrigerated frozen product storage compartment positioned within said hollow interior of said outer cabinet and behind said front panel, said frozen product storage compartment further comprising:

at least eight horizontally aligned frozen product delivery mechanisms, each said delivery mechanisms being driven by an independent driving motor, and each having an upper product carrying span and a lower product carrying span, said upper span and said lower span being connected to form a continuous loop; and a window in a front face of said frozen product storage compartment;

each of said upper product viewing opening, said window, and said at least eight horizontally aligned frozen product delivery mechanisms being in horizontal alignment such that all may be viewed from the front of said frozen product vending machine.

2. The frozen product vending machine of claim 1, wherein each said driving motor is mounted on the exterior of said refrigerated frozen product storage compartment and insulated from a low temperature environment within said refrigerated frozen product storage compartment.

3. The frozen product vending machine of claim 1, said refrigerated frozen product storage compartment further comprising:

a diffuse photoelectric switch, said diffuse photoelectric switch being electrically connected to each of said driving motors; and a laser light source directing a beam of light to said diffuse photoelectric switch, said beam being interruptable by the dispensing of a frozen product from said vending machine to operate said diffuse photoelectric switch, whereby operation of said switch initiates a timing cycle to terminate power to one of said driving motors after a predetermined amount of time.

4. The frozen product vending machine of claim 1, each of said product delivery means further comprising:

a roller chain comprised of a plurality of roller link plates, each said link plate being connected at one end to an adjacent link plate using a connecting pin, each said connecting pin extending outward beyond said link plate and defining an exposed pin portion, said roller chain forming a continuous loop;

a plurality of cradles removably attached to said roller chain, each said cradle having a downwardly extending flange, each said flange having an opening therein detachably receiving an exposed pin portion.

5. The frozen product vending machine of claim 4, wherein said roller chain is comprised of nylon.

6. The frozen product vending machine of claim 4, said refrigerated frozen product storage compartment having an interior bottom wall, top wall, back wall, and two side walls;

a vertically aligned front support plate attached to each of said side walls;

a vertically aligned rear support plate attached to each of said side walls;

a front roller chain driving gear rotatably mounted on said front support plate and engaged to one of said driving motors;

a rear roller chain driving gear rotatably and horizontally slidably mounted on said rear support plate; and a horizontally extensible rod operatively attached to each of said front and rear roller chain driving gears, whereby extension of said rod increases the horizontal distance between said front and rear roller chain driving gears to remove slack in said roller chain.

7. The frozen product vending machine of claim 1, said refrigerated frozen product storage compartment further comprising:

a cabinet having an open front face, said cabinet being capable of maintaining therein a refrigerated environment sufficient to store frozen consumable products;

a panel having a top portion and a bottom portion, said panel being fixedly attached to said open front face, said window being positioned in said top portion of said panel, said panel further comprising:

a product delivery opening positioned in said bottom portion of said panel; and an access door hingedly attached to said product delivery opening for allowing access to a bottom portion of said refrigerated frozen product storage compartment.

8. The frozen product vending machine of claim 7, wherein said window is heated to prevent the formation of frost on said window.

9. The frozen product vending machine of claim 7, said refrigerated frozen product storage compartment further comprising a panel in said bottom portion of said refrigerated frozen product storage compartment, said panel being positioned to prevent access to any portion of said frozen product storage compartment through said access door beyond said bottom portion.

10. A kit for converting an existing frozen or refrigerated product vending machine having an existing control system into a glass front frozen product vending machine comprising:

a freezer cabinet having an open front face;

a plurality of electric motors mounted on an exterior of said freezer cabinet;

a plurality of horizontally arranged product delivery conveyors mounted on an interior of said freezer cabinet and operatively engaged to said electric motors;

a panel fixedly attached to and covering said open face of said freezer cabinet, said panel further comprising:

a heated window hingedly attached to an upper portion of said panel for accessing an upper portion of said freezer cabinet;

an access door hingedly attached to a lower section of said panel for accessing a lower portion of said freezer cabinet; and electrical connectors for connecting each of said motors to said existing control system.

* * * * *